US011396185B2

(12) United States Patent
Naito

(10) Patent No.: US 11,396,185 B2
(45) Date of Patent: Jul. 26, 2022

(54) LIQUID CONTAINER

(71) Applicant: SEIKO EPSON CORPORATION, Tokyo (JP)

(72) Inventor: Naoki Naito, Ikeda-machi (JP)

(73) Assignee: SEIKO EPSON CORPORATION, Tokyo (JP)

( * ) Notice: Subject to any disclaimer, the term of this patent is extended or adjusted under 35 U.S.C. 154(b) by 22 days.

(21) Appl. No.: 17/132,012

(22) Filed: Dec. 23, 2020

(65) Prior Publication Data

US 2021/0197573 A1 Jul. 1, 2021

(30) Foreign Application Priority Data

Dec. 25, 2019 (JP) ..... JP2019-233823

(51) Int. Cl.
*B41J 2/175* (2006.01)

(52) U.S. Cl.
CPC ..... *B41J 2/17513* (2013.01); *B41J 2/1754* (2013.01)

(58) Field of Classification Search
CPC .... B41J 2/17513; B41J 2/1754; B41J 2/1752; B41J 2/17523; B41J 2/1753; B41J 2/17553
USPC ..... 347/86
See application file for complete search history.

(56) References Cited

U.S. PATENT DOCUMENTS

2020/0031132 A1* 1/2020 Ono ..... B41J 2/17513

FOREIGN PATENT DOCUMENTS

JP 2004-237746 A 8/2004
JP 2020-194115 A 12/2020

* cited by examiner

*Primary Examiner* — Kristal Feggins
*Assistant Examiner* — Alexander D Shenderov
(74) *Attorney, Agent, or Firm* — Oliff PLC

(57) ABSTRACT

A liquid container includes: a liquid containing section that stores liquid; a supply port joined to the liquid containing section, the supply port having an opening for supplying the liquid to an outside; a seal member disposed on an inner peripheral surface of the opening of the supply port; a cap configured to be attached to a position where it covers the supply port, the cap having a tubular protruding portion extending from a cap opening formed at a center of the cap, the protruding portion having a length sufficient to be inserted into the opening of the supply port; and a fixation portion that fixes the cap to the supply port, wherein the tubular protruding portion has a shape that abuts the seal member disposed on an inner peripheral surface of the opening when the cap is fixed to the supply port by the fixation portion.

9 Claims, 6 Drawing Sheets

LIQUID CONTAINER

The present application is based on, and claims priority from JP Application Serial Number 2019-233823, filed Dec. 25, 2019, the disclosure of which is hereby incorporated by reference herein in its entirety.

BACKGROUND

1. Technical Field

The present disclosure relates to liquid containers.

2. Related Art

Ink jet printers that perform printing by consuming ink as a liquid are known as one form of liquid consuming apparatuses. The ink consumed by an ink jet printer is supplied from an ink cartridge. The ink cartridge has a supply port for supplying ink to the ink jet printer. As an ink supply needle provided on the ink jet printer is inserted into the supply port of the ink cartridge, ink is supplied from the ink cartridge to the ink jet printer. JP-A-2004-237746 discloses a configuration in which a seal member is attached to an inner peripheral surface of the supply port to thereby achieve sealing between the supply port and the ink supply needle.

Although sealing between the supply port and the ink supply needle can be ensured by providing the above seal member on the inner peripheral surface of the supply port, there have been cases where sealing between the ink cartridge and the ink supply needle becomes insufficient due to aging degradation of the seal member when the ink cartridge is not mounted on the ink jet printer and stocked for a long period of time.

SUMMARY

The present disclosure can be implemented in the following forms. According to an embodiment of the present disclosure, a liquid container is provided. The liquid container includes: a liquid containing section that stores liquid; a supply port joined to the liquid containing section, the supply port having an opening for supplying the liquid to an outside; a seal member disposed on an inner peripheral surface of the opening of the supply port; a cap configured to be attached to a position where it covers the supply port, the cap having a tubular protruding portion extending from a cap opening formed at a center of the cap, the protruding portion having a length sufficient to be inserted into the opening of the supply port; and a fixation portion that fixes the cap to the supply port, wherein the tubular protruding portion has a shape that abuts the seal member disposed on an inner peripheral surface of the opening when the cap is fixed to the supply port by the fixation portion.

DESCRIPTION OF EXEMPLARY EMBODIMENTS

A. Configuration of Liquid Container 20

Figure 1:
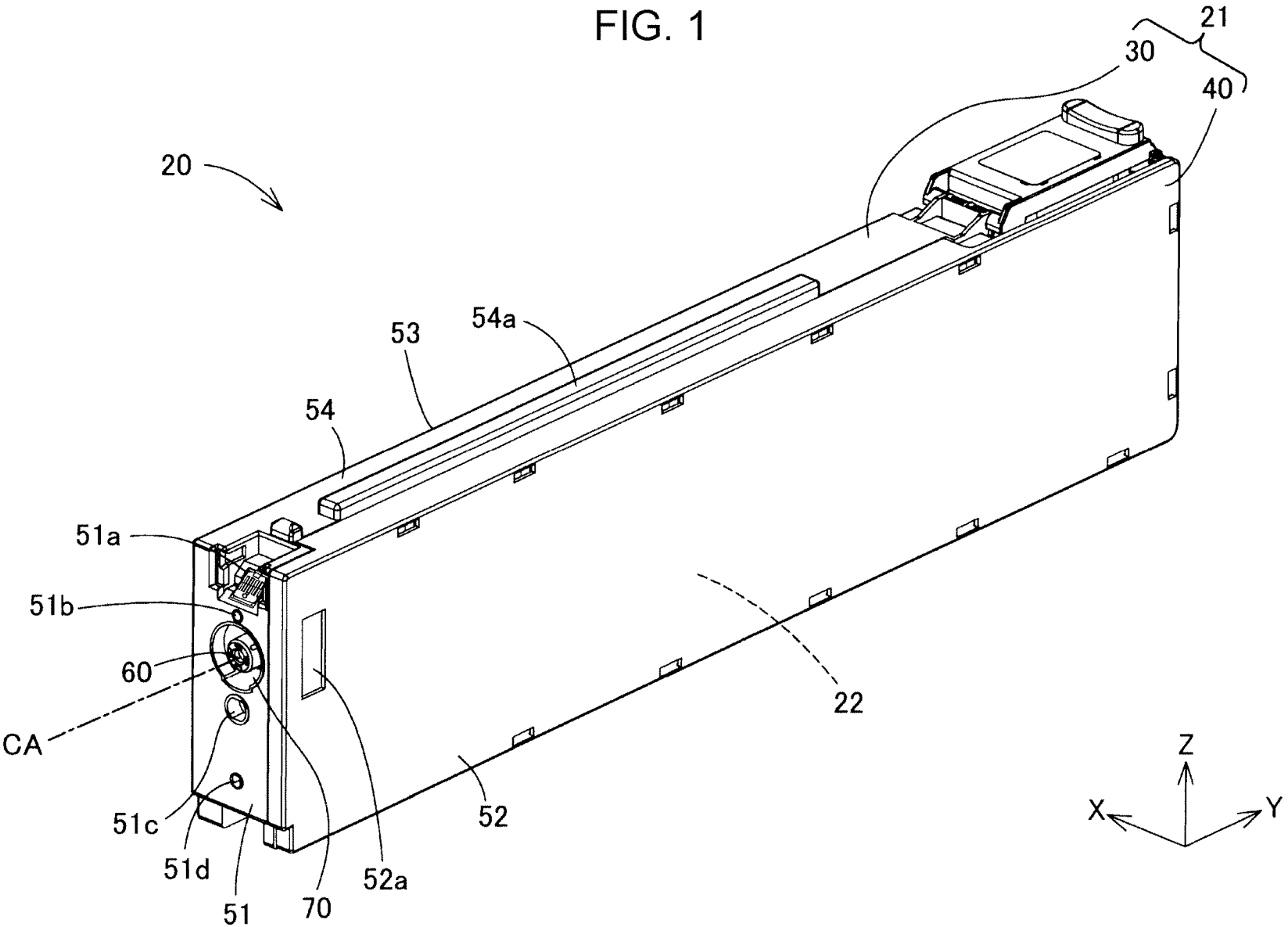
FIG. 1 is a schematic perspective view of a configuration of a liquid container.

FIG. 1 is a schematic perspective view of a configuration of a liquid container 20 used as an ink cartridge. In the following description, a direction extending in a longitudinal direction of the liquid container 20 is referred to as a front-back direction (Y axis direction). Specifically, a direction in which the Y axis arrow in the figure is oriented is a rear side, and the opposite direction is a front side. Further, a width direction of the liquid container 20, which is perpendicular to the Y axis direction as the front-back direction is referred to as an X axis direction. The X axis direction is also referred to as a left-right direction. Specifically, a direction in which the X axis arrow is oriented is a left side, and the opposite direction is a right side. In addition, a direction perpendicular to both the Y axis direction and the X axis direction is referred to as a Z axis direction. The Z axis direction is a direction parallel to the gravitational direction in use of the liquid container 20. The Z axis direction is also referred to as an up-down direction. Specifically, a direction in which the Z axis arrow is oriented is an upper side, and the opposite direction is a lower side. The same applies to the figures and the description thereafter. The X, Y, and Z axis directions indicated in the subsequent drawings correspond to the X, Y, and Z axis directions indicated in FIG. 1, respectively. An axis CA in FIG. 1 indicates a center axis of the supply unit 60 of the liquid container 20. The axis CA is parallel to the Y axis direction. A supply unit 60 will be described later.

The liquid container 20 is mounted on a liquid consuming apparatus. In the present embodiment, the liquid consuming apparatus is a printer. The printer is not shown in the drawings. The liquid container 20 contains ink as liquid to be supplied to the printer. As shown in FIG. 1, the liquid container 20 has a substantially cuboid outer shape. The liquid container 20 includes an outer casing 21. The outer casing 21 is formed by combining left and right cases, a case 30 and a case 40, which are two separable cases. In manufacturing of the liquid container 20, a film member (not shown) is adhered to an opening of the left case 30 of the outer casing 21 to form a liquid containing section 22 for storing ink between the case 40 and the film member. Then, the right case 40 is fitted to the case 30. In the present embodiment, the case 30 and the case 40 are fitted to each other by a claw and a groove formed on an end thereof. However, the case 30 and the case 40 can also be fixed and adhered to each other by using an adhesive.

The outer casing 21 is a hexahedron having a front end face of the liquid container 20 as a first surface 51, a right side face continuous from the first surface 51 as a second surface 52, a left side face continuous from the first surface 51 as a third surface 53, and a top face as a fourth surface 54. The second surface 52 and the third surface 53 are positioned to sandwich the first surface 51 and the fourth surface 54. In this specification, the "surface" may not necessarily be a flat surface, but also be a curved surface, and may also have asperities, shoulders, grooves, bent portions, inclined surfaces, apertures, slits and the like.

Figure 2:
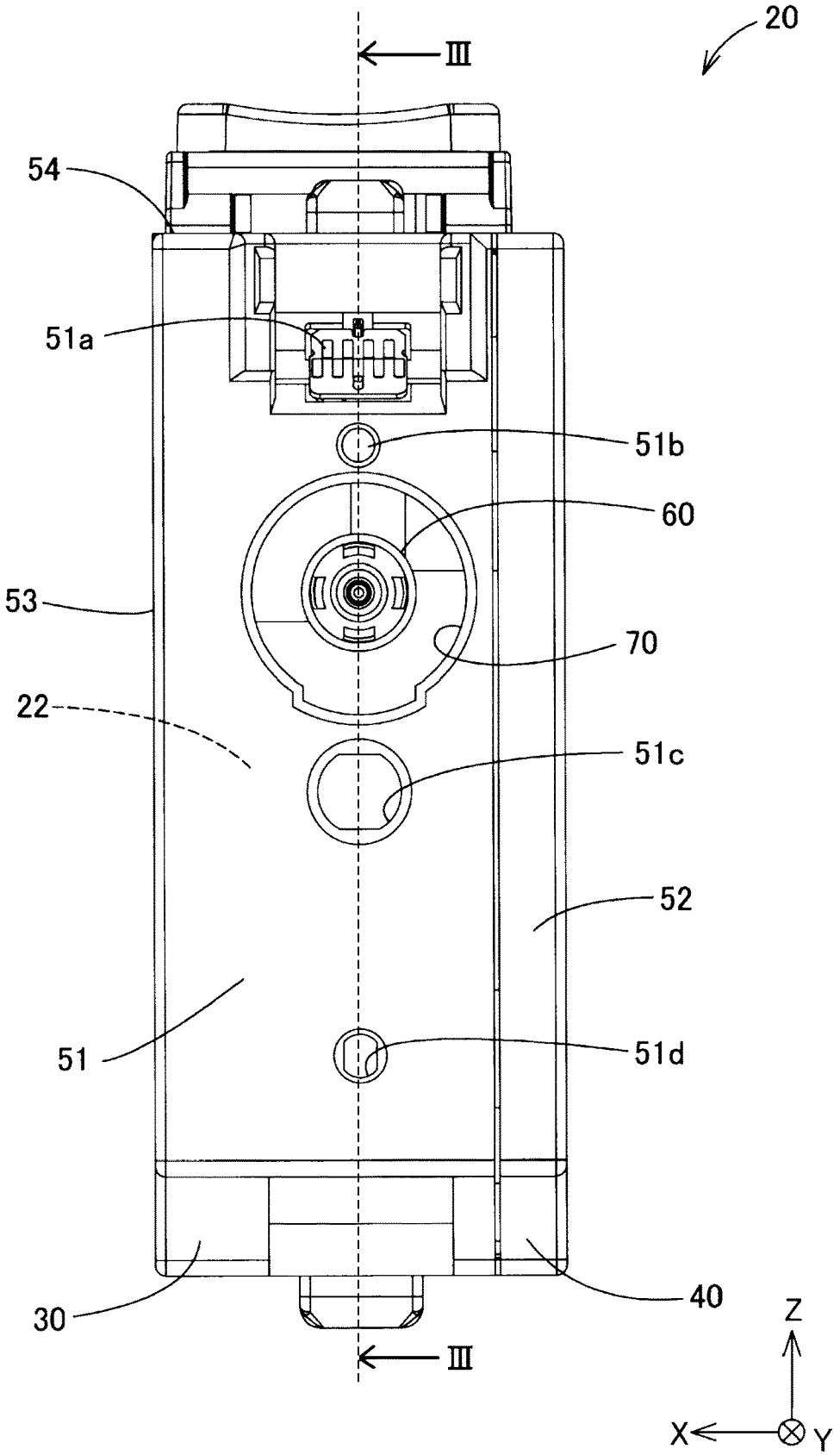
FIG. 2 is a front view of a liquid container.

FIG. 2 is a front view of the liquid container 20. The first surface 51, which is a side inserted when mounted on the printer, has a connecting section 51*a* that performs electrical connection to the printer, an ink pool 51*b* for preventing stains due to leaked ink, a supply unit 60 that supplies ink to the printer, a positioning portion 51*c* for positioning the liquid container 20 relative to the printer when attached to the printer, and an ink pool 51*d* for collecting leaked ink, which are arranged in descending order in the Z axis direction. The supply unit 60 will be detailed later.

Figure 3:
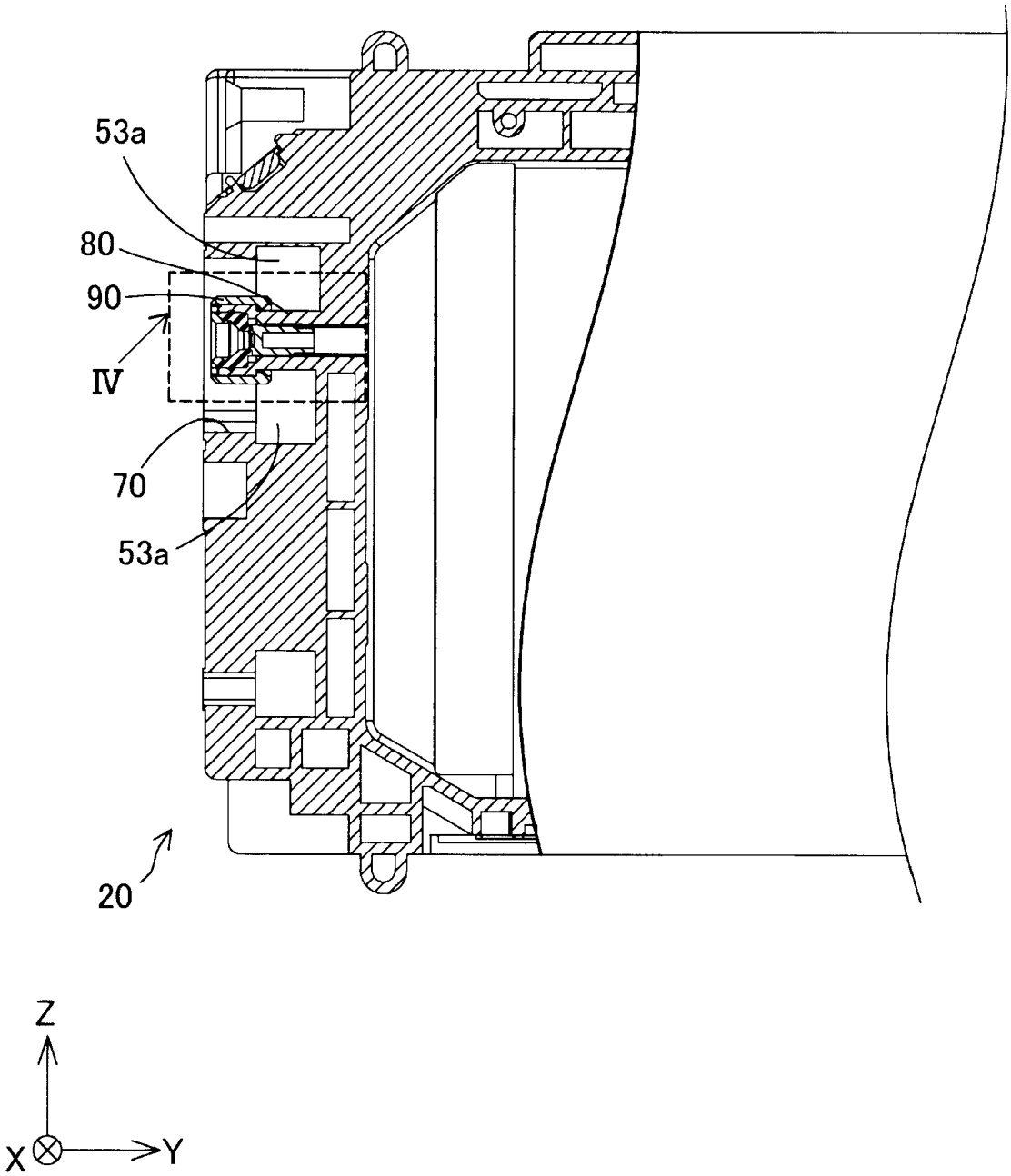
FIG. 3 is a partial cross-sectional view taken along the line III-III of FIG. 2.

As shown in FIG. 1, a rectangular first opening 52*a* is disposed on the second surface 52. The first opening 52*a* is a through hole penetrating the second surface 52. The first opening 52*a*, when viewed from the right, is disposed at a position continuous to a recess 70, which will be described later. Further, a second opening 53*a* is disposed on the third surface 53. The second opening 53*a* is shown in FIG. 3, which will be described later. The second opening 53*a* is a through hole penetrating the third surface 53. The second opening 53*a*, when viewed from the left, is disposed at a position continuous to the recess 70 and the first opening 52*a*. The functions of the first opening 52*a* and the second opening 53*a* will be described later.

A rail 54*a* is provided on the fourth surface 54. The rail 54*a* is formed as a raised portion having a straight shape extending in a direction in which the liquid container 20 is inserted into the printer. In the present embodiment, the insertion direction into the printer is a direction parallel to the Y axis. The rail 54*a* has a function of guiding the movement direction of the liquid container 20 in attachment and detachment of the liquid container 20 to and from the printer.

Figure 4:
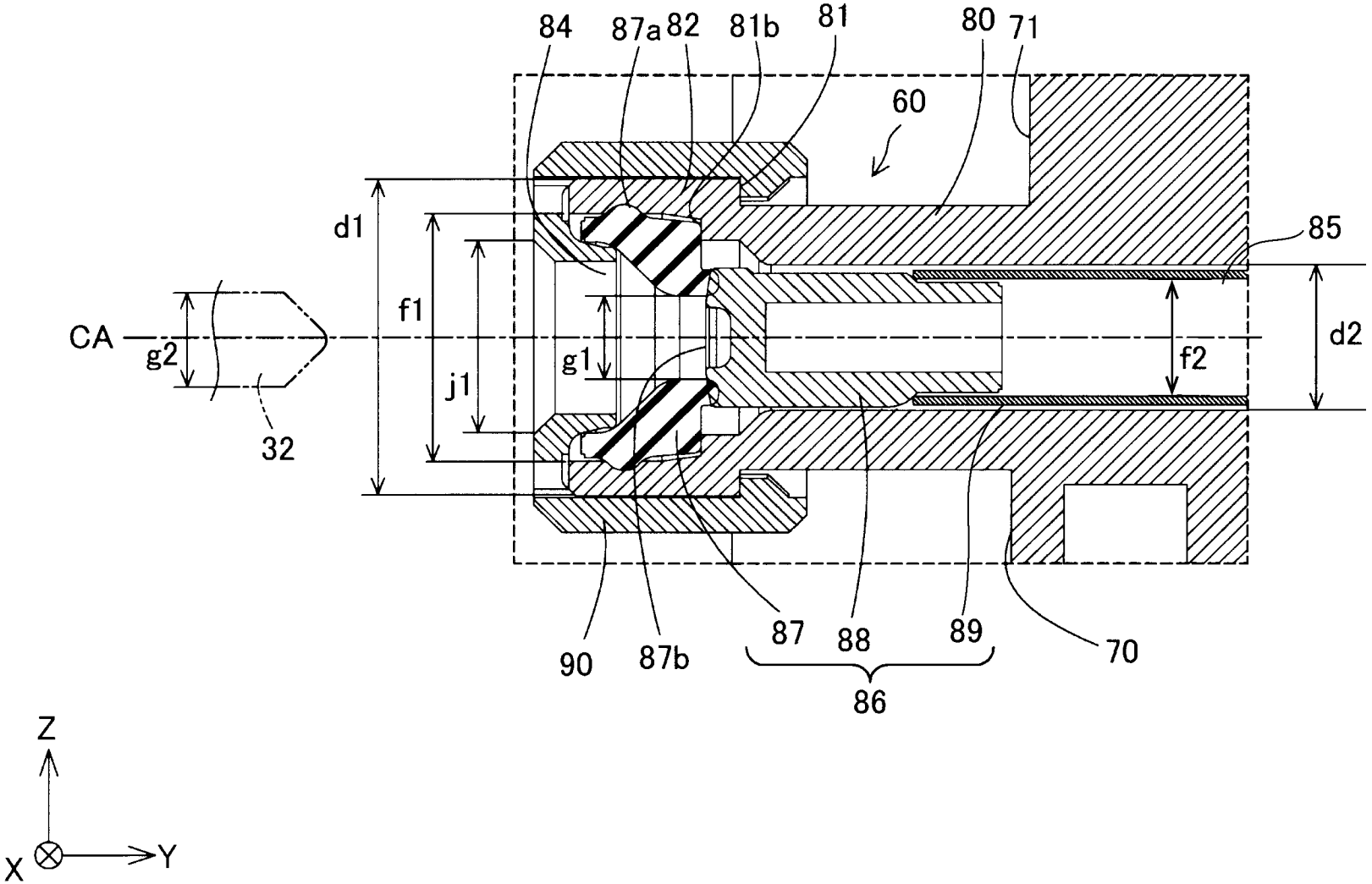
FIG. 4 is an enlarged view of a IV region of FIG. 3, illustrating a structure of a supply unit.

FIG. 3 is a partial cross-sectional view taken along the line III-III of FIG. 2. For convenience of understanding, the second surface 52 is partially shown in FIG. 3. FIG. 4 is an enlarged view of a IV region of FIG. 3, illustrating a structure of the supply unit 60. As shown in the appearance view of FIG. 1 and in FIG. 2, the recess 70 is formed on the first surface 51 such that the supply unit 60 is formed therein. As shown in FIG. 4, a supply port forming portion 80 extends from a bottom 71 of the recess 70 in a direction of the axis CA. The supply port forming portion 80, the recess 70, and the opening 84 have a circular cross-section taken in a direction perpendicular to the axis CA. As shown in FIG. 3, a space sufficient for attachment of a cap 90, which will be described later, is provided between the outer periphery of the supply port forming portion 80 and the inner wall of the recess 70.

As shown in FIG. 4, the supply port forming portion 80 is formed as a hollow cylinder having an inner flow path 85, and is provided with a supply port 82 on a distal end in the axis CA direction, that is, on the printer side end. The supply port 82 has an outer diameter d1, which is larger than an outer diameter d2 of a proximal end of the supply port forming portion 80. Accordingly, a shoulder 81 is formed on the outer periphery of the distal end of the supply port forming portion 80 at a position adjoining to the supply port 82. The shoulder 81 functions as a fixation portion for fixing the cap 90 to the supply port 82. Further, the supply port 82 has an inner diameter f1, which is larger than an inner diameter f2 of the flow path 85, and an inner shoulder 81*b* is formed.

The flow path 85 in the supply port forming portion 80 includes a valve mechanism 86 configured to open and close a path between the opening 84 that communicates with the liquid containing section 22 and allows ink to be supplied to the outside and the flow path 85. The valve mechanism 86 includes a valve body 88 with a seal member 87 described later as a valve seat, and a spring 89 that biases the valve body 88 in a direction toward the opening 84.

The seal member 87 made of a silicone rubber, which serves as a valve seat for receiving the valve body 88, is inserted through the opening 84 of the supply port forming portion 80 and fitted on the inner peripheral surface of the supply port 82. The seal member 87 has an outer diameter slightly larger than an inner diameter of the opening 84, and is inserted to a position where it abuts the inner shoulder 81*b* of the opening 84. Accordingly, a rear end of the seal member 87, that is, an end facing the flow path 85, abuts the valve body 88 biased by the spring 89.

The seal member 87 is formed in an annular shape such that an ink supply needle 32 can pass therethrough, and has an engagement projection 87*a* protruding outward from the outer periphery. The inner diameter of the seal member 87 decreases toward the rear end, forming a funnel shape. Accordingly, the seal member 87 has a thickness which increases toward the rear end where the valve body 88 abuts. Further, an inner diameter g1, which is the smallest inner diameter of the seal member 87 is smaller than an outer diameter g2 of the ink supply needle 32.

The engagement projection 87*a* on the outer periphery of the seal member 87 is fitted in a groove formed on an inner peripheral surface of the supply port 82 so that the seal member 87 fitted inside the supply port 82 is not detached from the supply port 82. Furthermore, the cap 90 is fitted into the supply port 82 to hold the seal member 87.

The valve body 88 is a substantially cylindrical member. The valve body 88 closes a seal member aperture 87*b* formed in the seal member 87 before the liquid container 20 is mounted on the printer. The spring 89 is a compression coil spring. The spring 89 biases the valve body 88 toward the seal member 87.

Figure 5:
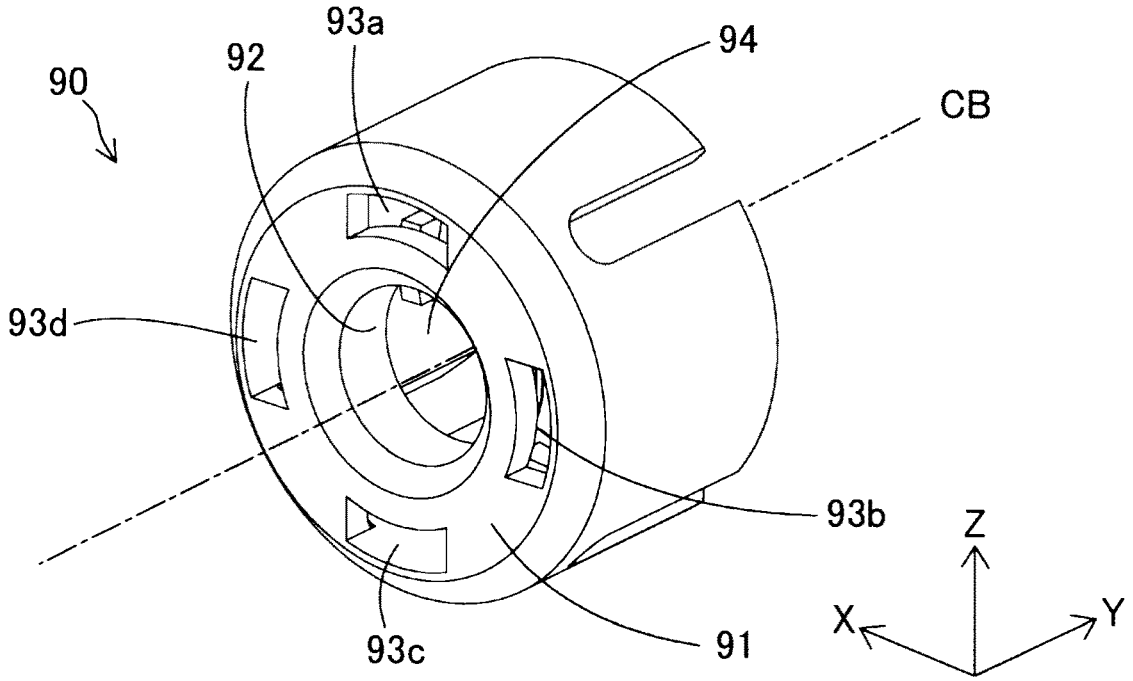
FIG. 5 is a perspective view of an inside and an outside of a cap.
Figure 6:
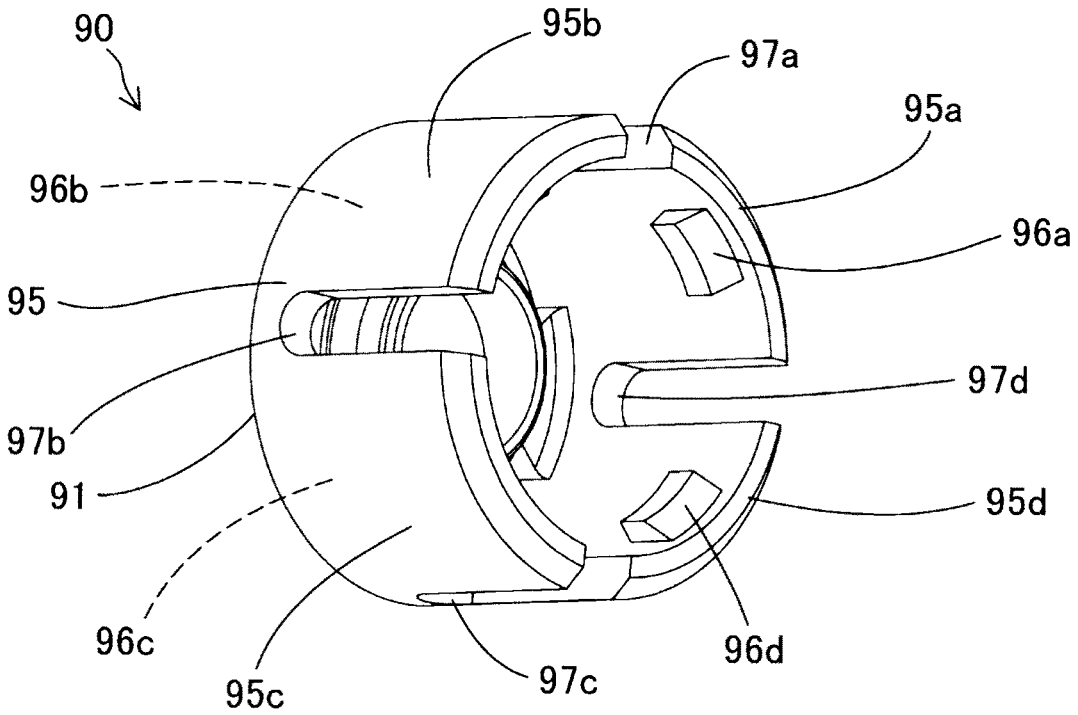
FIG. 6 is a perspective view of an inside and an outside of a cap.
Figure 7:
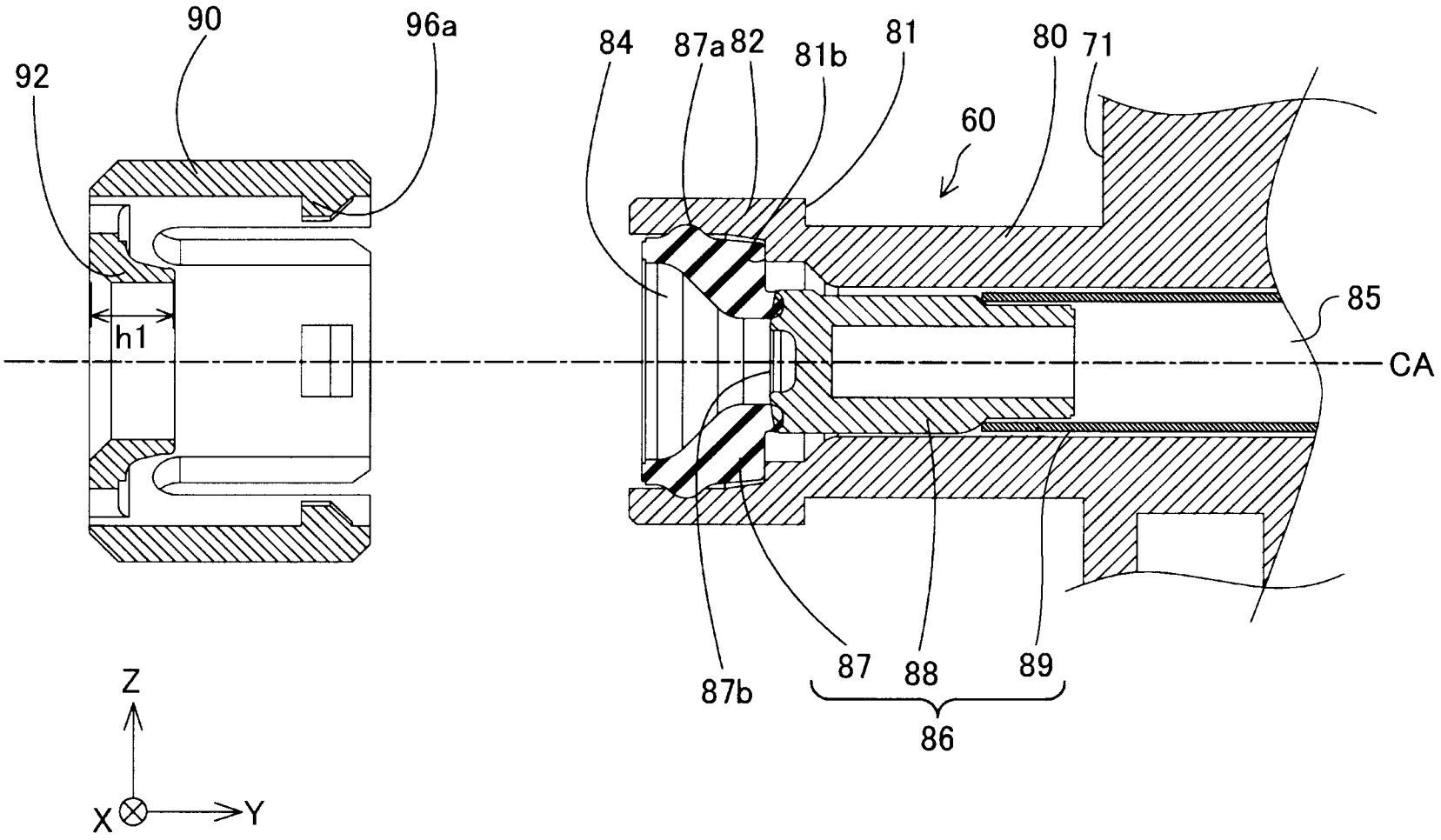
FIG. 7 is a view illustrating a state of a cap before it is attached to a supply port.

As shown in FIGS. 1 to 4, the cap 90 is attached to the supply port 82 at a position where it covers the supply port 82. In the following description, with reference to FIGS. 4 to 7, the detailed structure of the cap 90 will be described. FIGS. 5 and 6 are perspective views of an inside and an outside of the cap 90. FIG. 7 is a view illustrating a state of the cap 90 before it is attached to the supply port 82. In FIG. 7, the cap 90 is shown by the cross-section taken along an axis CB of FIG. 5 in the Y-Z plane.

As shown in FIGS. 5 to 7, the cap 90 has a tubular shape having an outer peripheral wall fitted onto the supply port 82 as a whole. In the following description, a direction extending along the axis CB of the tubular cap 90 is referred to as an axis direction. The front side of the tubular cap 90 in FIG. 5 is referred to as a front end in the axis direction, and the other side is referred to as a rear end in the axis direction. In FIGS. 4 and 7, since the axis CB coincides with the axis CA, the axis CB is omitted and only the CA is shown.

The front end of the tubular body is a front end face 91, and a circular cap opening 94 is formed at the center thereof. The cap opening 94 is continuous to an inner wall of a tubular protruding portion 92, which extends toward the rear end. As shown in FIG. 7, the protruding portion 92 has a length h1 sufficient to be inserted into the opening 84.

As shown in FIG. 5, four through holes 93*a* to 93*d* surrounding the cap opening 94 are formed in the front end face 91. Further, as shown in FIG. 6, an outer peripheral wall 95, which extends from the outer periphery of the front end face 91 toward the rear end in parallel to the protruding portion 92, is divided into four arms 95*a* to 95*d* by four notches 97*a* to 97*d*. The notches 97*a* to 97*d* are arranged at positions corresponding to the respective intermediate positions between the four through holes 93*a* to 93*d* formed in the front end face 91. On the inner wall of the end of the arms 95*a* to 95*d*, four engagement claws 96*a* to 96*d*, respectively, are formed. The engagement claws 96*a* to 96*d*, together with the shoulder 81, function as fixation portions for fixing the cap 90 described later to the supply port 82.

In attachment of the cap 90 to the opening 84, the cap 90 in the state shown in FIG. 7 is inserted onto the supply port forming portion 80 along the axis CA. As the cap 90 is fitted on the supply port forming portion 80, the inclined portion on the end of the engagement claws 96*a* to 96*d* rides on the outer periphery of the supply port 82, causing the arms 95*a* to 95*d* to be slightly elastically deformed outward.

As the cap 90 is further pushed inside, the engagement claws 96*a* to 96*d* reach the shoulder 81. When the engagement claws 96*a* to 96*d* pass by the shoulder 81, the arms 95*a* to 95*d* return to the original shape, causing the engagement claws 96*a* to 96*d* to engage with the shoulder 81. Thus, the cap 90 is fixed to the supply port 82.

When the protruding portion 92 formed inside the cap 90 is thus inserted into the opening 84 as shown in FIG. 4, the seal member 87 is held between the inner wall of the supply port 82 and the protruding portion 92. While the cap 90 is attached to the supply port 82, the protruding portion 92 is closely fit on the inner periphery of the end of the seal member 87. In this case, in order to prevent the cap 90 from interfering with an end of the seal member 87 to damage the seal member 87 when attached to the supply port 82, the outer wall of the end of the protruding portion 92 is slightly tapered.

Accordingly, since the cap 90 fixes the seal member 87, which is held between the protruding portion 92 and the inner wall of the supply port 82, the seal member 87 can be prevented from falling down toward the inside of the opening 84 even if the shape of the seal member 87 becomes unstable due to aging degradation. As a result, deterioration of sealing between the seal member 87 and the supply port 82 can be prevented. Further, since the inside of the seal member 87 has a funnel shape, the end of the protruding portion 92 naturally abuts a thickened wall of the seal member 87 when the cap 90 is attached. Accordingly, the seal member 87 is regulated so as not to be displaced outside the opening 84, that is, in the −Y axis direction. As a result, deterioration of sealing between the seal member 87 and the valve body 88 can be prevented.

Referring to FIG. 4, a mechanism of supplying ink from the liquid container 20 to the printer when the liquid container 20 is mounted on the printer will be described. As the liquid container 20 is mounted on the printer, the ink supply needle 32 is inserted into the opening 84 of the supply port 82. The ink supply needle 32 enters the seal member aperture 87*b* inside the seal member 87, and the tip of the ink supply needle 32 abuts the end of the valve body 88 on a side facing the seal member 87. As the liquid container 20 is further pushed, the tip of the ink supply needle 32 pushes the valve body 88 against the biasing force of the spring 89. Accordingly, the valve body 88 separates from the rear end of the seal member 87 to thereby open the valve mechanism 86. As a result, ink can flow into an ink flow path formed inside the ink supply needle 32 via an ink opening formed on the tip end surface of the ink supply needle 32. In the drawing, the ink flow path is not illustrated. Since the outer diameter g2 of the ink supply needle 32 is larger than the inner diameter g1 of the seal member aperture 87*b* of the seal member 87 as previously described, the outer periphery of the ink supply needle 32 is sealed by the seal member 87 to prevent ink from leaking outside.

As described above, the opening 84, the supply port forming portion 80, and the recess 70 have a circular cross-section taken in a direction perpendicular to the axis CA, and the cap 90 is attached to the supply port 82 when the arm 95*a* engages with the shoulder 81. Accordingly, in attachment of the cap 90 to the supply port 82, the cap 90 can be attached at any position relative to the supply port 82. That is, a rotation position about the axis is not limited as long as the axes are aligned with each other. Accordingly, the cap 90 can be easily attached to the supply port 82. Further, since the supply port forming portion 80 can be used for attachment of the cap 90, the cap 90 can be reliably fixed with a simple shape.

In this embodiment, as described above, the first opening 52*a*, when viewed from the right, is disposed at a position continuous to the recess 70, described later, such that the shoulder 81 can be straightly reached from the first opening 52*a* on the second surface 52. Further, as shown in FIG. 7, when the liquid container 20 is viewed from the left, the shoulder 81 can be straightly reached from the second opening 53*a* on the third surface 53. Therefore, when the first surface 51, the second surface 52, and the third surface 53 are integrally formed by using a mold, the mold can be removed via the first opening 52*a* and the second opening 53*a*. Accordingly, the shoulder 81 can be easily formed.

B. Other Embodiments (B1) In the present embodiment, the seal member 87 is held between the protruding portion 92 of the cap 90 and the inner wall of the supply port 82 so that the seal member 87 is prevented from falling down inward, and the end of the protruding portion 92 abuts a thickened wall of the funnel-shape of the seal member 87 to thereby regulate displacement of the seal member 87 toward outside. Alternatively, the length of the protruding portion of the cap in the axis direction may be shortened to the degree that the protruding portion does not abut the thickened portion. Further, the protruding portion may also be formed to abut the thickened portion of the seal member but does not hold the seal member between the seal member and the inner wall of the supply port.

(B2) In the present embodiment, the protruding portion 92 has a tubular shape. However, the protruding portion may not necessarily have the entire circumference, and may be any shape as long as it abuts the seal member to thereby prevent the seal member from falling down inward or being disposed toward outside. When the arms are formed, the lengths and widths may not necessarily be uniform.

(B3) The arms of the cap may not necessarily be four, and may be one or five or more. The arm may not be provided. For example, the supply port and the cap may be fixed to each other by engaging a male thread formed on the outer periphery of the supply port with a female thread formed on the inner periphery of the cap. An engagement portion corresponding to the engagement claw may also be provided on the front end face. The engagement claw may not be provided, and an inner surface of the front end face may be adhered to the end face of the supply port forming portion.

In this case, a shoulder is not formed on the supply port forming portion, and, when the supply port forming portion is formed by using a mold, it is not necessary to remove the mold via the first opening and the second opening. Accordingly, the first opening and the second opening are not required. Further, even when a shoulder is provided, the first opening and the second opening are not required if the outer casing of the liquid container is formed by using a 3D printer.

(B4) The supply port forming portion is not limited to a cylindrical shape, and may be an elliptical cylindrical shape, a rectangular prism shape, or a pillar shape having a polygonal cross section. In such a case, the cap may be formed according to the shape of the end of the supply port forming portion. The cap may have a shape that abuts the seal member, and the shape may not necessarily be a similar figure to the supply port forming portion as long as it can be attached to the supply port forming portion.

(B5) The supply port forming portion may not be formed in the recess, and the supply port may be formed in the first surface. In this case, the cap can be fixed to the first surface. The cap can be fixed by using an adhesive or a tape, or by inserting the cap into a hole formed in the first surface.

(B6) In the present embodiment, liquid supplied to the printer is ink. However, liquid other than ink, such as chemical solution, oil, or drinking water, can also be used.

(B7) In the present embodiment, the liquid consuming apparatus is a printer, but it can also be applied to apparatuses other than printers, for example, facsimile machines, and color material ejection apparatuses used for manufacturing of color filters for image display apparatuses such as liquid crystal displays.

(B8) In the present embodiment, the liquid container 20 includes the ink pool 51*b*, the positioning portion 51*c*, and the ink pool 51*d*. However, other configurations can also be adopted, in which these components are not be provided in the liquid container 20, for example.

(B9) In the present embodiment, the rail 54*a* is provided on the fourth surface as a raised portion having a straight shape. However, other configurations can also be adopted, in which no rail is provided on the fourth surface, for example.

(B10) In the present embodiment, the seal member 87 is made of a silicone rubber. However, the seal member may also be made of other materials such as butyl rubber or fluorine rubber.

(B11) In the present embodiment, the inside of the seal member 87 has a funnel shape with the inner diameter f1 decreasing toward the rear end. However, the inside of the seal member may have other shapes such as one having a constant inner diameter from the front end to the rear end.

(B12) In the present embodiment, the spring 89 is a compression coil spring, but the spring may be formed of other elastic members such as a rubber spring.

C. Other Forms

The present disclosure is not limited to the above embodiments and can be embodied in various forms without departing from the spirit thereof. For example, the present disclosure can be implemented in the following forms. Technical features in the above embodiments corresponding to the technical features in the respective forms described below can be appropriately replaced or combined in order to solve all or part of the problems of the present disclosure, or achieve all or part of the effects of the techniques of the present disclosure. Further, technical features can be appropriately deleted as long as they are not described in the specification as indispensable features.

(1) According to an embodiment of the present disclosure, a liquid container is provided. The liquid container includes: a liquid containing section that stores liquid; a supply port joined to the liquid containing section, the supply port having an opening for supplying the liquid to an outside; a seal member disposed on an inner peripheral surface of the opening of the supply port; a cap configured to be attached to a position where it covers the supply port, the cap having a tubular protruding portion extending from a cap opening formed at a center of the cap, the protruding portion having a length sufficient to be inserted into the opening of the supply port; and a fixation portion that fixes the cap to the supply port, wherein the tubular protruding portion has a shape that abuts the seal member disposed on an inner peripheral surface of the opening when the cap is fixed to the supply port by the fixation portion. In this form, the cap fixes the seal member to the inner peripheral surface of the opening at a position where it abuts the seal member. As a result, deterioration of sealing properties of the seal member can be reduced.

(2) In the liquid container of the above form, the liquid container may be composed of a plurality of surfaces, a recess may be formed on a first surface, which is one of the plurality of surfaces, a supply port forming portion that forms the supply port may be disposed on a bottom of the recess, the supply port forming portion may have a shoulder formed on a distal end, the shoulder having an outer dimension larger than that of a proximal end, the cap may have a plurality of engagement claws, and the fixation portion may be formed of the shoulder configured to engage with the engagement claws when the cap is attached to a position where it covers the supply port. In this form, the supply port forming portion can be used in attachment of the cap. Accordingly, the cap can be reliably fixed with a simple shape.

(3) In the liquid container of the above form, the opening, the supply port forming portion, and the recess, having an axis direction in a direction in which the supply port forming portion extends, may have a circular cross-section taken in a direction perpendicular to the axis direction, and the cap may include a plurality of arms extending from an outer periphery of the cap in a direction parallel to a protruding direction of the protruding portion, the plurality of engagement claws being provided on an inner wall of an end of the arms. In this form, in attachment of the cap to the supply port, the cap can be attached at any position relative to the supply port. That is, a rotation position about the axis is not limited as long as the axes are aligned with each other. Accordingly, the cap can be easily attached to the supply port.

(4) In the liquid container of the above form, the protruding portion of the cap may have an outer dimension that abuts an inside of the seal member when the cap is fixed to the supply port. In this form, the seal member can be prevented from falling down toward the inside of the opening even if the shape of the seal member becomes unstable due to aging degradation. As a result, deterioration of sealing between the seal member and the supply port can be prevented.

(5) In the liquid container of the above form, the protruding portion of the cap may have a shape that abuts a surface of the seal member which is oriented to the opening of the supply port when the cap is fixed to the supply port. In this form, the cap regulates displacement of the seal member toward outside the opening. As a result, deterioration of sealing properties of the seal member can be reduced.

(6) In the liquid container of the above form, a second surface and a third surface sandwiching the first surface may have an opening which is continuous to the recess such that the shoulder is straightly reached from the opening on the second surface and the third surface. In this form, when the first surface, the second surface, and the third surface are integrally formed by using a mold, the mold can be removed via the opening. Accordingly, the shoulder can be easily formed.

What is claimed is:

1. A liquid container comprising:

a liquid containing section that stores liquid;

a supply port joined to the liquid containing section, the supply port having an opening for supplying the liquid to an outside;

a seal member disposed on an inner peripheral surface of the opening of the supply port;

a cap configured to be attached to a position where it covers the supply port, the cap having a tubular protruding portion extending from a cap opening formed at a center of the cap, the protruding portion having a length sufficient to be inserted into the opening of the supply; port such that the protruding portion overlaps the supply port along an axis of the opening of the supply port; and a fixation portion that fixes the cap to the supply port, wherein the tubular protruding portion has a shape that abuts the seal member disposed on an inner peripheral surface of the opening when the cap is fixed to the supply port by the fixation portion.

2. The liquid container according to claim 1, wherein the liquid container is composed of a plurality of surfaces, a recess is formed on a first surface, which is one of the plurality of surfaces, a supply port forming portion that forms the supply port is disposed on a bottom of the recess, the supply port forming portion has a shoulder formed on a distal end, the shoulder having an outer dimension larger than that of a proximal end, the cap has a plurality of engagement claws, and the fixation portion is formed of the shoulder configured to engage with the engagement claws when the cap is attached to a position where it covers the supply port.

3. The liquid container according to claim 2, wherein the opening, the supply port forming portion, and the recess, having an axis direction in a direction in which the supply port forming portion extends, have a circular cross-section taken in a direction perpendicular to the axis direction, and the cap includes a plurality of arms extending from an outer periphery of the cap in a direction parallel to a protruding direction of the protruding portion, the plurality of engagement claws being provided on an inner wall of an end of the arms.

4. The liquid container according to claim 3, wherein the proximal end of the supply port forms the shoulder and the plurality of engagement claws protrude inward from the inner wall of the arms.

5. The liquid container according to claim 2, wherein a second surface and a third surface sandwiching the first surface have an opening which is continuous to the recess such that the shoulder is straightly reached from the opening on the second surface and the third surface.

6. The liquid container according to claim 2, wherein the proximal end of the supply port forms the shoulder.

7. The liquid container according to claim 1, wherein the protruding portion of the cap has an outer dimension that abuts an inside of the seal member when the cap is fixed to the supply port.

8. The liquid container according to claim 1, wherein the protruding portion of the cap has a shape that abuts a surface of the seal member which is oriented to the opening of the supply port when the cap is fixed to the supply port.

9. The liquid container according to claim 1, wherein an inner surface of the supply port completely covers an outer surface of the seal member.

* * * * *